US005217365A

United States Patent [19]

Frigiere

[11] Patent Number: 5,217,365

[45] Date of Patent: Jun. 8, 1993

[54] LIGHTER WITH DELAYED GAS RELEASE

[75] Inventor: Rene Frigiere, Rillieux La Pape, France

[73] Assignee: Cricket, Rillieux la Pape, France

[21] Appl. No.: 851,003

[22] Filed: Mar. 11, 1992

[30] Foreign Application Priority Data

Mar. 14, 1991 [FR] France ..... 91 03365

[51] Int. Cl.[5] ..... F23D 14/28

[52] U.S. Cl. ..... 431/344; 431/142; 431/130; 431/277

[58] Field of Search ..... 431/129, 152, 153, 344, 431/277, 142, 130; 251/236, 242, 244, 245, 246; 222/402.15, 5.3

[56] References Cited

U.S. PATENT DOCUMENTS

| | | | |
|---|---|---|---|
| 3,961,876 | 6/1976 | Chernock | 431/344 |
| 3,966,392 | 6/1976 | Lockwood | 431/344 |
| 4,047,669 | 9/1977 | Gutai | 431/344 X |
| 4,773,849 | 9/1988 | Schächter . | |
| 5,090,893 | 2/1992 | Floriot | 431/153 |

FOREIGN PATENT DOCUMENTS

| | | |
|---|---|---|
| 2273992 | 1/1976 | France . |
| 2280029 | 2/1988 | France . |

OTHER PUBLICATIONS

Search Report Issued in French Application 9103365 (priority application) listing the above patents.

*Primary Examiner*—Larry Jones
*Attorney, Agent, or Firm*—Herbert Dubno; Andrew Wilford

[57] ABSTRACT

A lighter has a body forming a reservoir holding a supply of a flammable gas under pressure, a valve on the body openable to allow the gas to escape from the reservoir as a jet extending along an axis and normally urged open by the pressure of the gas, and an igniter on the body for lighting the jet. An operating lever pivoted on the body about an axis orthogonal to the jet axis has a front end normally bearing axially downward on the valve and a rear end and is formed as front and rear segments joined only by a central elastic web permitting the segments to move limitedly elastically relative to each other. Stops limit relative movement of the lever segments. A spring braced between the body and the lever rear end rotationally biases the lever front end downward on the valve with a predetermined first force greater than the force exerted oppositely on the valve by the gas. The web forces the front segment downward on the valve with an axial downward force smaller than the first force of the first spring and greater than the opposite gas force.

3 Claims, 1 Drawing Sheet

LIGHTER WITH DELAYED GAS RELEASE

FIELD OF THE INVENTION

The present invention relates to a lighter of the type normally used for cigarettes and cigars. More particularly this invention concerns such a lighter using gas as a fuel and equipped with a cutout to prevent operation by a child.

BACKGROUND OF THE INVENTION

A standard lighter with delayed gas release such as described in U.S. Pat. No. 4,773,849 of F. Schachter and French patent 2,273,992 has a body forming a reservoir filled with a supply of a normally gaseous combustible stored as a liquid, a pressure-reducer/evaporator on an outlet of the reservoir, and a burner/valve that closes the gas outlet. This valve is operated by a lever pivoted about an axis orthogonal to that of the burner/valve and has a front end normally applied against a shoulder of the burner/valve and constantly maintaining the valve closed against a force exerted on it by the gas. The lever also has a rear operating end that is constantly acted on by a spring urging it pivotally in a direction corresponding to closing of the valve, that is pressing the valve shoulder axially downward. Such a lighter is lit by pressing down the rear end of the lever against the above-mentioned spring to free the valve so that it opens under the action of the pressurized gas and so as to operate slightly afterward a mechanism for producing a lighting spark.

It is easy to see that it is preferable that opening of the valve only take place at the end of actuation of the lever, not only in order that gas is only released at the instant of production of the spark in the case that this is after the starting of movement of the lever so as to favor lighting but also in order that the time the valve is opened is reduced as much as possible. Since in addition it is common that such a lighter is squeezed in the pocket of a garment or a bag it is possible that one of the conditions it is subject to tends to tip the lever somewhat in a direction opening the valve and, unless there is a neutral stroke, such tipping inherently leads to a useless loss of gas.

It is also particularly important that the valve only be opened at the end of the travel of its control lever when the lighter is a childproof lighter. Such a device, as described in copending patent application 651,332 filed Feb. 7, 1991, has a mechanism for blocking the control lever in the closed position of the valve that is capable of being maneuvered into an out-of-the-way position in order to permit lighting of the flame but that is automatically returned to the active blocking position after each actuation of the control lever.

This childproofing mechanism comprises movable abutments normally situated in the path of a part of the rear end of the control lever. In order that this mechanism perfectly performs its function it is necessary that it be opposed to any pivoting of the lever, even through a very short stroke, because as soon as it is released by the control lever the valve is pushed into the open position by the pressurized gas freed by the pressure- reducer/evaporator. However, manufacturing tolerances do not allow one to eliminate all play between the control lever and the movable abutments of the blocking mechanism and in addition the progressive deformation of the lever, in particular caused by heat of the lighter flame, tends to increase this play to the detriment of safety.

In French patent 2,280,029 of M. E. Coggiola a lighter of the above-described type is known in which opening of the valve by the control lever is delayed by the use of a second biasing means interposed between the first spring and the valve and set to act on the valve in series and in the same direction as the first spring, that is in the direction of closing of the valve but with a force less than that of the first spring but more than that caused by the pressure of gas and tending to open the valve. Thus when the lighter is in the rest position, that is when the valve is closed, the first spring maintains the second biasing means in maximum activated position, that is compressed, and the sum of the two forces is opposed to opening of the valve. It is only during actuation of the control lever in the direction of opening the valve that the second biasing means continues all alone, to start with, to oppose opening of the valve and it is only on further actuation of the control lever that there is a sufficient deactivation of the second biasing means to allow opening of the valve. Thus the presence of this second biasing means delays opening of the valve by a time corresponding to a predetermined fraction of the angular travel or free path in the closing direction of the valve of the control lever for opening and closing.

In the lighter of the above-cited French patent the second biasing means is formed by the control lever which to this end is shaped to have an elastically deformable section between its front end bearing on the burner/valve and its rear end. The front end of the control lever which completely or partially surrounds the upper end of the burner/valve is divided by a V-section notch into upper and lower sections connected to each other by a web of elastic material forming an elastic hinge. The lower section is normally inclined downward but can be pushed elastically toward the upper section with a force smaller than that caused by the first spring but greater than that caused by the pressure of the gas under the valve. While giving complete satisfaction as far as function is concerned, this lighter has the disadvantage of being expensive because of the price of its control lever.

OBJECTS OF THE INVENTION

It is therefore an object of the present invention to provide an improved lighter.

Another object is the provision of such an improved lighter which overcomes the above-given disadvantages, that is which is provided with a child-safety cutout and a delayed gas release, but that is still inexpensive to manufacture.

SUMMARY OF THE INVENTION

A lighter according to this invention has a body forming a reservoir holding a supply of a flammable gas under pressure, a valve on the body openable to allow the gas to escape from the reservoir as a jet extending along an axis and normally urged open by the pressure of the gas, and an igniter on the body for lighting the jet. An operating lever pivoted on the body about an axis orthogonal to the jet axis has a front end normally bearing axially downward on the valve and a rear end and is formed as front and rear segments joined only by a central elastic web permitting the segments to move limitedly elastically relative to each other. Stops limit relative movement of the lever segments. A spring braced between the body and the lever rear end rotationally biases the lever front end downward on the valve with a predetermined first force greater than the force exerted oppositely on the valve by the gas. The web forces the front segment downward on the valve with an axial downward force smaller than the force of the first spring and greater than the opposite gas force.

According to the invention the lever is formed with an axially upwardly open notch having a base formed by the web and a pair of sides forming the stops and engageable with each other on upward deflection of both segments.

Thus with the system of this invention the lever will normally be in a position with the stops formed by the flanks of the notch in engagement with each other and the rear end of the lever pushed all the way up by its spring. As the rear end is pushed down, at first this will only cause the rear lever segment to pivot relative to the front lever segment, opening up the notch but not causing the front segment to move at all so that the valve remains closed. Only when the rear segment is pushed down enough to straighten out the web, does the front segment start to lift to open the valve. Thus the first part of the pivotal stroke of the rear lever segment is a neutral path so that such minor actuation of the lever will not open the valve.

BRIEF DESCRIPTION OF THE DRAWING

The above and other objects, features, and advantages will become more readily apparent from the following, reference being made to the accompanying drawing in which.

SPECIFIC DESCRIPTION

Figure 1:
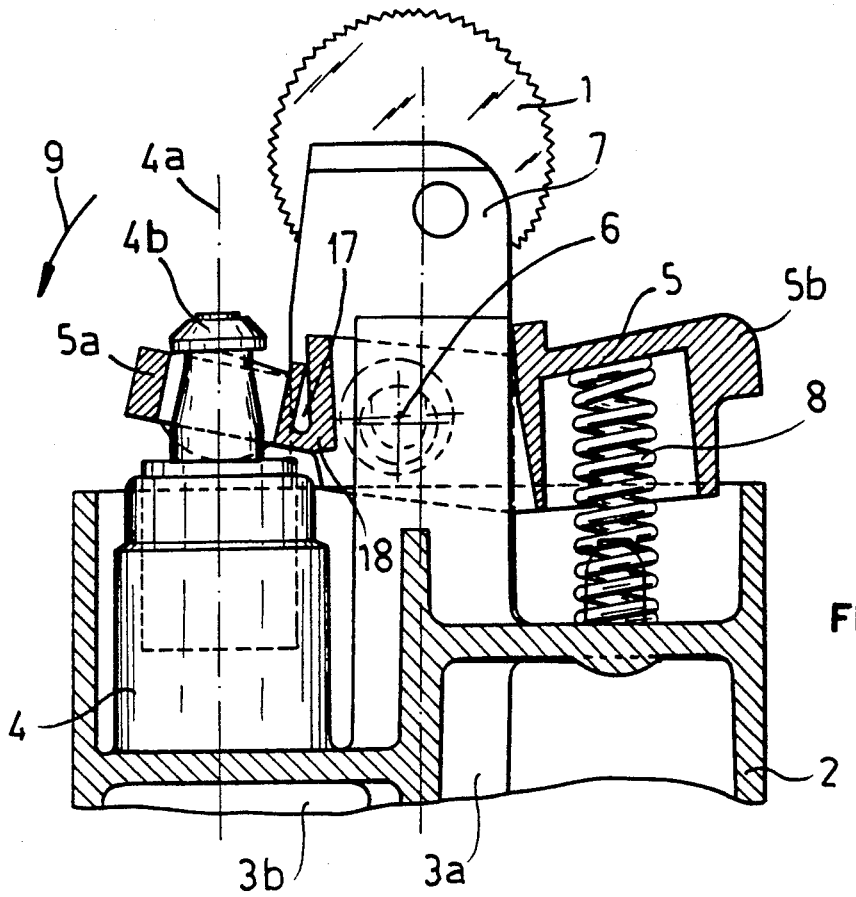
FIGS. 1 and 2 are partial vertical sections showing the upper portion of the gas lighter according to a simple embodiment of the invention, with the control lever for opening and closing of the burner/valve respectively in the rest position and the closed position of the burner/valve and immediately before opening the burner/valve.
Figure 2:
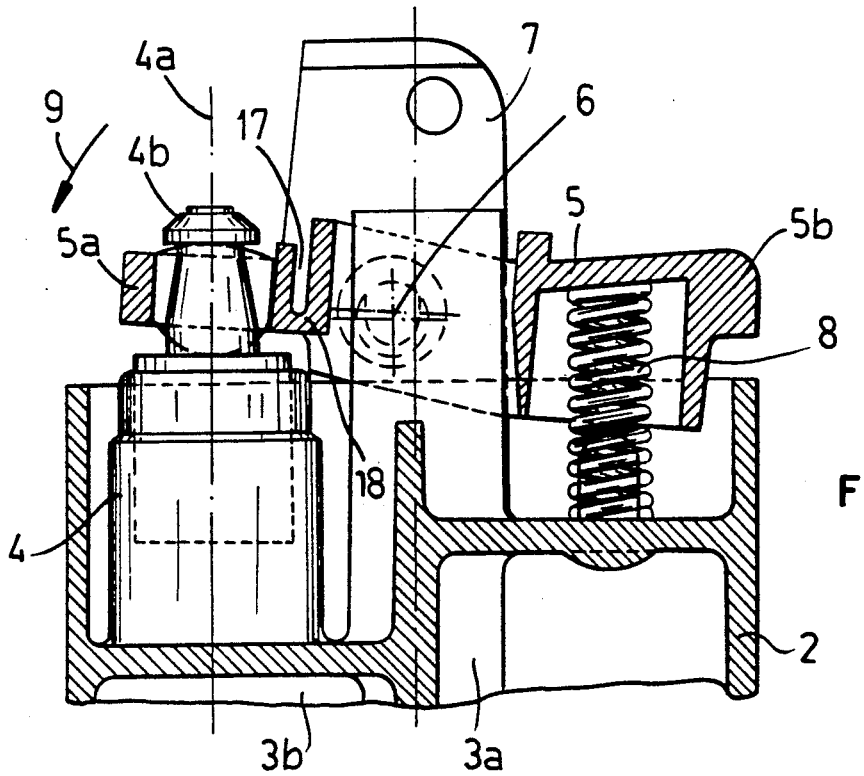

As seen in the drawing, the lighter has a body 2 formed with two communicating compartments 3*a* and 3*b* forming a supply reservoir normally at least partially filled with a gaseous combustible that is stored as a liquid. The upper part of the body 2 of the lighter supports on its front side, to the left in the drawing, a burner/valve 4 centered on a vertical axis 4*a* and having an upper end 4*b* movable axially and normally maintained in the lower closed position as illustrated in FIGS. 1 and 2 of the drawing by a control lever 5 for opening and closing the burner/valve 4. A horizontal pivot axis 6 of the lever 5 is carried by a pivot whose one lug 7 is shown in the drawing.

The lever 5 has a front end 5*a* that is positioned to the left in the drawing and that is formed as a crown so as to surround the upper end 4*b* of the burner/valve 4 and also has a rear operating end 5*b* that is continuously subjected to the action of a helical spring 8 compressed between it and the upper part of the body 2 of the lighter. This spring 8, which constitutes the first spring or biasing means of the lighter, tries continuously to pivot the lever 5 in the direction of arrow 9, that is so that its front end 5*a* maintains the burner/valve 4 closed by pressing against a shoulder of this burner/valve 4. Pressing axially downward on the rear end 5*b* of lever 5 pivots it in a direction opposite that of the arrow 9 so as to lift the burner/valve 4 to the open position under the effect of gas pressure.

The jet of gas that is emitted along the axis 4*a* by the valve 4 is ignited by a spark generated by an igniting mechanism here constituted by a standard ridged wheel 1 cooperating with a flint that is not illustrated. Thus when the rear lever end 5*b* is depressed and the wheel 1 is rotated the gas jet is ignited. As the lever 5 is held in the depressed condition the jet will continue to burn. This lighting mechanism which can be of any type, such as pyrophoric stone, piezoelectric quartz, or the like is set up to be operated at the same time, just before or just after the control lever 5 opens the burner/valve 4.

The force which the lever 5 is continuously subjected to by the spring 8 tends to bend it in a direction corresponding to advancing the moment when the burner/valve 4 opens. In addition heat communicated by the burner/valve 4 to the lever 5 tends to deform it in the same direction. This premature opening of the burner/valve is to be avoided because it is a source of extra useless consumption.

In addition in childproof lighters of this type having underneath the rear operating end 5*b* of the lever 5 a movable stop serving to limit the pivoting in the direction of opening the burner/valve, requirements of automatic assembly of these lighters plus manufacturing conditions of their component parts make it inevitable that there will be some play between the lever 5 and the movable stops, this play making it possible to open the burner/valve 4 is spite of the presence of the stops. In this case this premature opening is to be avoided at all costs because it completely nullifies the precautions taken with respect to children.

This is why between the first biasing means serving to guarantee closing of the burner/valve 4 and formed in the examples illustrated in the drawing by the helical spring 8 and the burner/valve 4 there is provided a second spring or biasing means serving to create a second closing force for the burner/valve 4, independent of the first one and mounted in series with same in order to act in the same direction, but with a force that is less than that of the first one but greater than that caused by the pressure of the combustible trying to open the burner/valve 4. Thus even when the first biasing means is deactivated by action on the lever 5 serving to pivot it in the direction corresponding to freeing of the burner/valve 4, that is in the direction opposite to that of the arrow 9, the second biasing means assures that the burner/valve 4 is maintained in the closed position right up until it is actuated in turn by the pivoting of the lever 5 in the above-mentioned direction.

Naturally the angular travel of the lever 5 corresponding to opening the burner/valve 4, or the free path, depends on the deflection of the second biasing means corresponding to the balancing of its force with that caused by the pressure of gas upstream of the burner/valve 4. This deflection is easy to determine as a function of the type of the second biasing means.

In the example illustrated by FIGS. 1 and 2 the front crown-shaped lever end 5*a* is partially separated from the rest of this lever by a vertical upwardly open notch 17. Thus the connection between the two segments formed by this lever 5 is only made by a lower web 18 of supple and elastic material, here the plastic material of which the lever 5 is formed as a unitary piece by molding or injection. This lower web 18 plays the role of an elastic hinge assuring elastic deformation of the lever 5 as shown in FIG. 7 and thus forms the second biasing or spring means.

When the lever 5 is only subjected to the force of the spring 8, it is deformed elastically until the notch 17 is closed by meeting of its sides that form stops that limit the elastic deformation of the lever 5. This deformation corresponds to the neutral travel of the lever 5 whose end is shown in FIG. 8.

I claim:

1. A lighter comprising:

a body forming a reservoir;

a supply of a flammable gas under pressure in the reservoir;

a valve on the body openable to allow the gas to escape from the reservoir as a jet extending along an axis and normally urged axially open by the pressure of the gas;

means on the body for igniting the jet;

an operating lever pivoted on the body about an axis orthogonal to the jet axis and having a front end normally bearing axially downward on the valve and a rear end, the lever being formed as front and rear segments joined only by a central elastic web permitting the segments to move limitedly elastically relative to each other;

stops limiting relative movement of the lever segments;

first spring means braced between the body and the lever rear end for rotationally biasing the lever front end downward on the valve with a predetermined first force greater than the force exerted oppositely on the valve by the gas; and second spring means formed by the web and bearing downward on the valve for exerting on the valve an axial downward force smaller than the first force of the first spring means and greater than the opposite gas force.

2. The delayed-release lighter defined in claim 1 wherein the lever front end is formed with a throughgoing aperture through which the valve projects.

3. A lighter comprising:

a body forming a reservoir;

a supply of a flammable gas under pressure in the reservoir;

a valve on the body openable to allow the gas to escape from the reservoir as a jet extending along an axis and normally urged open by the pressure of the gas;

means on the body for igniting the jet;

an operating lever pivoted on the body about an axis orthogonal to the jet axis and having a front end normally bearing axially downward on the valve and a rear end, the lever being formed as front and rear segments joined only by a central elastic web permitting the segments to move limitedly elastically relative to each other, the lever being formed with an axially upwardly open notch having a base formed by the web and a pair of sides;

stops formed by the sides of the notch and engageable with each other on upward deflection of both segments to limit relative movement of the lever segments;

first spring means braced between the body and the lever rear end for rotationally biasing the lever front end downward on the valve with a predetermined first force greater than the force exerted oppositely on the valve by the gas; and second spring means formed by the web and bearing downward on the valve for exerting on the valve an axial downward force smaller than the first force of the first spring means and greater than the opposite gas force.

* * * * *